US006517793B1

(12) United States Patent
Tamminen et al.

(10) Patent No.: US 6,517,793 B1
(45) Date of Patent: Feb. 11, 2003

(54) METHOD OF REDUCING $NO_X$ COMPOUNDS IN FLUE GASES OF RECOVERY BOILER

(75) Inventors: Ari Tamminen, Pirkkala (FI); Seppo Tuominiemi, Pirkkala (FI); Risto Hämäläinen, Tampere (FI)

(73) Assignee: Kvaerner Pulping Oy, Tampere (FI)

( * ) Notice: Subject to any disclaimer, the term of this patent is extended or adjusted under 35 U.S.C. 154(b) by 0 days.

(21) Appl. No.: 09/646,406

(22) PCT Filed: Mar. 19, 1999

(86) PCT No.: PCT/FI99/00217

§ 371 (c)(1),
(2), (4) Date: Sep. 18, 2000

(87) PCT Pub. No.: WO99/47746

PCT Pub. Date: Sep. 23, 1999

(30) Foreign Application Priority Data

Mar. 19, 1998 (FI) ..... 980619

(51) Int. Cl.[7] ..... C01C 3/00
(52) U.S. Cl. ..... 423/237; 423/235
(58) Field of Search ..... 423/235, 237, 423/239.2

(56) References Cited

U.S. PATENT DOCUMENTS 3,881,004 A * 4/1975 Kelly et al. ..... 423/235
4,626,417 A * 12/1986 Young ..... 423/235
4,957,716 A * 9/1990 Cichanowicz et al. ..... 423/235
5,009,869 A * 4/1991 Weinberg et al. ..... 423/210
5,454,908 A 10/1995 Olausson
5,562,887 A * 10/1996 Landscheidt et al. ..... 423/235
6,030,494 A 2/2000 Hupa et al.

FOREIGN PATENT DOCUMENTS

| | | |
|---|---|---|
| JP | 188923/1991 | 8/1991 |
| SE | 451 334 | 9/1987 |
| WO | WO 94/20676 | 9/1994 |

OTHER PUBLICATIONS

Peter H. Anderson et al., *An Analysis of Best Available Control Technology Options for Kraft Recovery Furnace No. Emissions,* Tappi Journal, Jan. 1991, pp. 115–118.

* cited by examiner

*Primary Examiner*—Stanley S. Silverman
*Assistant Examiner*—Edward M. Johnson
(74) *Attorney, Agent, or Firm*—Wood, Phillips, Katz, Clark & Mortimer

(57) ABSTRACT

A method of reducing $NO_X$ compounds in the odor gases of a recovery boiler. In the method, ammonia in the odor gases is separated before the odor gases are combusted, the ammonia being then introduced into a recovery boiler at the pulp mill or in a separate catalyzer, where the ammonia reacts with nitrogen oxide forming water and molecular nitrogen.

24 Claims, 1 Drawing Sheet

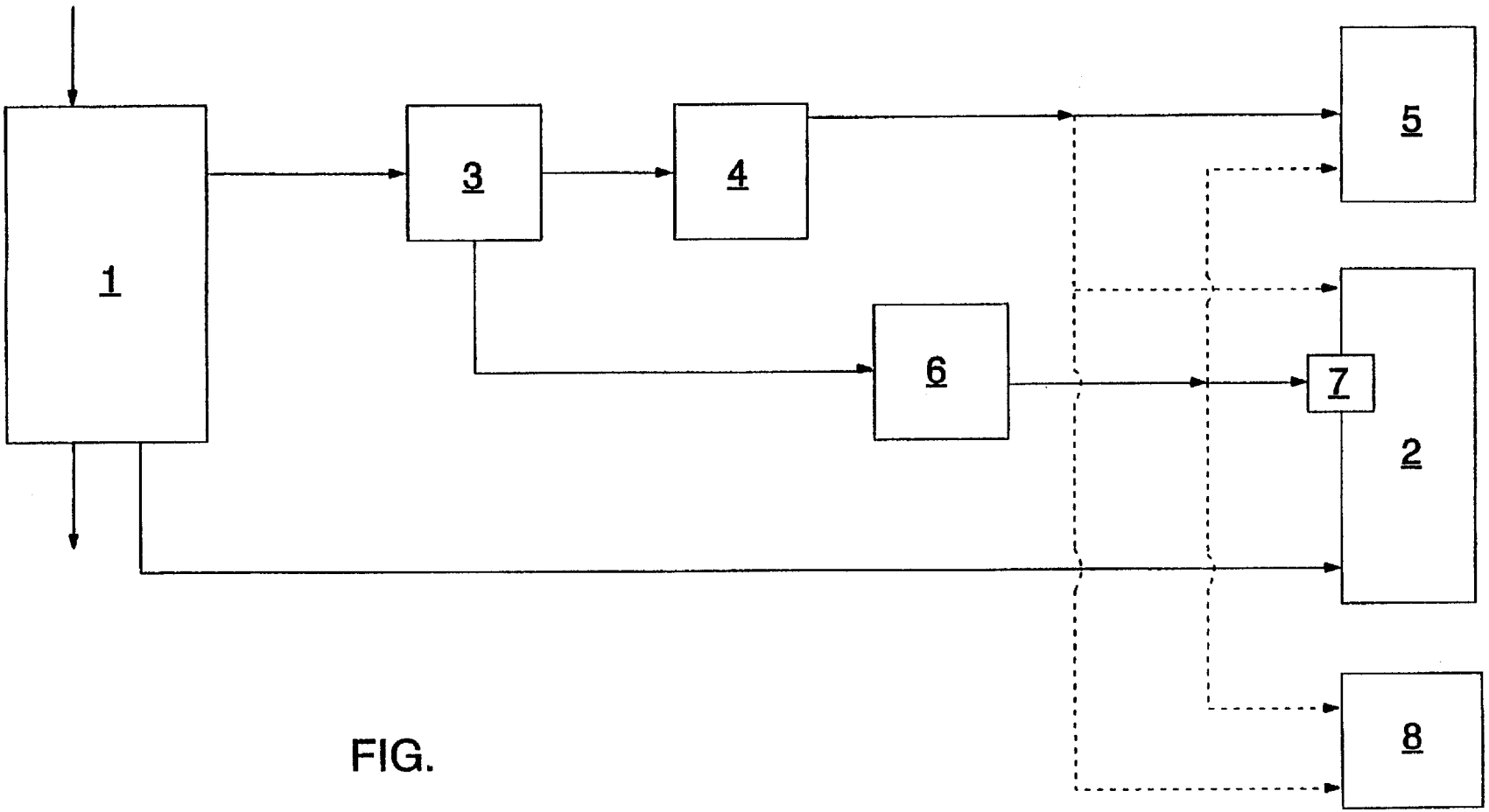
FIG.

METHOD OF REDUCING $NO_X$ COMPOUNDS IN FLUE GASES OF RECOVERY BOILER

TECHNICAL FIELD OF THE INVENTION

The invention relates to a method of reducing nitrogen oxide emissions at a pulp mill in the combustion of odor gases that are released in different process steps at the pulp mill and contain detrimental sulphur compounds.

At a pulp mill, in a pulp cooking process, organic nitrogen originating from wood is separated in gaseous form, particularly in the form of ammonia, but also as other gaseous nitrogen compounds, during different process steps, such as cooking, evaporation, stripping etc. When methanol or turpentine is condensed from these odor gases, part of the ammonia is also condensed into liquid form with the methanol or turpentine. When odor gases are combusted in different boilers, such as a recovery boiler, a power boiler or a separate odor gas boiler, ammonia is oxidized into various nitrogen oxides, increasing nitrogen emissions at said mills. High phasing of air feed to reduce nitrogen oxide emissions easily results in an increase in ammonia and flue sulphur emissions. Similarly, combusting methanol or turpentine in different boilers induces either various nitrogen oxides or ammonia emissions. The most problematic issue is the inability to systematically avoid the formation of detrimental emissions in combustion of methanol and odor gases that contain a plurality of different compounds.

Attempts have been made to reduce emissions of nitrogen compounds, i.e. mainly nitrogen oxides, from recovery and power boilers by what is known as stepped combustion, in which air is supplied to a boiler in several successive steps to make combustion take place mainly under-stoichiometric conditions. This considerably reduces the formation of what is known as thermal $NO_x$. Such a solution is disclosed e.g. in Swedish Published Specification No. 468 171.

Attempts have also been made to reduce $NO_x$ contents in flue gases by supplying various reagents to flue gases for preventing the formation of $NO_x$ compounds or for converting them into a form in which they can be removed as easily as possible, Such an additive may be ammonia or urea purchased outside the mill, in which case the NO present in the flue gas reacts with ammonia, forming gaseous nitrogen which can be discharged to the atmosphere. It is also possible to use various solid or liquid ammonium salts as the reagent in this so-called SNCR method known per se. The problem with this technique is the high cost of reagents to be purchased outside the mill.

It is also known to supply hydrocarbons, such as natural gas or the like, to flue gases in a boiler, the resulting reduction in $NO_x$ compounds being due to so-called hydrocarbon radicals speeding up the reactions of nitrogen compounds. The drawbacks of such methods are the high investment and operating costs, since the additives are purchased outside the mill, and in addition, equipment is required for storing, batching, adjusting and feeding the additives.

Finnish Patent Application No. 931055 discloses a method in which oxygenous hydrocarbon, such as methanol, obtained in the pulp cooking process, is supplied to flue gases in a recovery boiler. In this method, methanol and any aqueous steam are supplied to the upper part of a recovery boiler to be mixed with flue gases, whereupon the flue gases are washed with white liquor or with an aqueous solution containing ammonia-based and/or alkali-based compounds. The method is based on the nitrogen oxide NO contained in the flue gases becoming partly oxidized and forming nitrogen dioxide $NO_2$, which can be removed by an alkali scrubber. The drawback of this method is that it has an effect only on the reduction in oxides of already formed nitrogen, and the only reagent that can be used is methanol or a corresponding hydrocarbon derivative. In addition, the method requires a flue gas scrubber suitable for removing $NO_2$, and the treatment of nitrogen compounds remaining in the washing liquid is still problematic.

SUMMARY OF THE INVENTION

The object of the present invention is to provide a method of reducing the number of nitrogen oxide and ammonia emissions readily caused by combustion of odor gases and methanol. The method of the invention is characterized by separating the ammonia contained in the odor gases before they are introduced into combustion.

The essential feature of the invention is that the ammonia in odour gases and methanol is separated, and, consequently, when they are combusted, this prevents the formation of ammonia-induced nitrogen oxides or pure ammonia which would be discharged to the atmosphere with the flue gases. In a preferred embodiment of the invention, the ammonia thus separated is supplied to a boiler in use at the pulp mill by what is known as the SNCR method, to remove nitrogen oxides from the flue gases of said boiler. In another preferred embodiment of the invention, ammonia is separated from odor gases and/or methanol by what is known as a molecular sieve, e.g. by using zeolite.

BRIEF DESCRIPTION OF THE DRAWING

The invention will be described in greater detail in the attached drawing which schematically shows the method of the invention as a block diagram.

DETAILED DESCRIPTION OF THE INVENTION

The wood to be cooked is supplied to pulp mill cooking, in which various constituents and wood fibres are separated therefrom. Wood fibres are led forward after various washings and black liquor remaining from the cooking is led via various process steps, such as an evaporator etc., to be combusted in a recovery boiler. Pulp cooking and other steps associated with processing black liquor before it is supplied to a recovery boiler constitute a process known per se, schematically denoted in the block diagram by reference numeral 1. From this process various odor gases are separated both in cooking and in evaporators in what is known as stripping and super concentration, should the equipment comprise such a step. These odor gases are recovered and led to further processing to maintain detrimental emissions from the pulp mill as low as possible and additionally to recover both the chemicals and the combustion energy of the odor gases. In the final step of the pulp process, black liquor is sprayed to the recovery boiler 2 for combustion and recovery of the chemicals therein.

Odor gases, or at least part of them, are led to a condensing step 3, in which methanol is condensed into liquid form. At the same time, part of the ammonia is condensed with the methanol and mixed with it in a liquid form. The odor gases are then supplied to ammonia separation 4, where gaseous ammonia is separately separated from the odor gases, whereupon the odor gases are supplied to combustion in e.g. a recovery boiler 2. The gaseous ammonia obtained from ammonia separation, in turn, can be led either to a recovery boiler 2 or to a separate power boiler 5 to be used by what is known as the SNCR, or selective non-catalytic, method to react with nitrogen oxides in the flue gases and to thus form molecular nitrogen and water. The ammonia is supplied to said boiler in a suitable temperature window, which is preferably in the temperature range from 920 to 950° C.

Methanol, in turn, is separately supplied to a second ammonia separation step 6, where ammonia is separated from methanol. Methanol can then be led to combustion either in a power boiler or to be used as support fuel in a recovery boiler, an odor gas burner 7 or a separate odor gas boiler 8. If desired, the previously mentioned odor gases can also be combusted either in a power boiler or in a separate odor gas boiler. The ammonia separated from methanol, in turn, can be introduced in the above described manner into some boiler in use in a suitable temperature window to form molecular nitrogen and water with nitrogen oxide.

Ammonia is separated in the separation step preferably by what is known as a molecular sieve, such as zeolite, resulting in extremely pure ammonia, while other impurities are led to combustion with odor gases or methanol. The ammonia thus obtained can be used for various purposes, and, used with the SNCR method, process adjustment and, consequently, reduction in emissions can be achieved efficiently without extra non-controlled emissions.

Ammonia may also be separated from gas or methanol by a water scrubber, and in this case it naturally has to be separated from the washing solution before further processing or use.

Ammonia may also be separated from odor gases before methanol condensation, should this be easier from the technical point of view of the process. In this case only one separation step is required, and ammonia does not have to be separately removed from methanol after it has been condensed. In addition to the SNCR method, ammonia can also be used with a catalytic method, i.e. the SCR method, whereby ammonia is typically supplied to flue gases at a temperature of between 350 and 400° C. to a special catalyzer, simultaneously avoiding secondary reactions of sulphuric compounds. Furthermore, ammonia can be delivered from a pulp mill to other uses or be used for the preparation of ammonium sulphate for fertilizers. In view of the economic operation of a pulp mill, it is, however, preferable to use the separated ammonia to reduce nitrogen oxide emissions in a boiler in use at the pulp mill.

What is claimed is:

1. A method of reducing nitrogen oxide emissions at a pulp mill during combustion of odor gases in a boiler comprising the steps of:

a) separating ammonia that exists in the odor gases directly from other components of the odor gases prior to combustion of said gases in a boiler; and b) introducing the ammonia separated in step a) to said boiler to induce removal of nitrogen oxide by selective non-catalytic nitrogen oxide removal.

2. The method of claim 1 wherein ammonia is separated from said odor gases in step a) by a water scrubber.

3. The method of claim 1 wherein ammonia is separated from said odor gases in step a) by a molecular sieve.

4. The method of claim 3 wherein said molecular sieve is a zeolite.

5. The method of claim 1 further comprising separation of methanol containing a portion of the existing ammonia from said odor gases after step a) and before step b).

6. The method of claim 1 further comprising separation of methanol that contains a portion of the existing ammonia from said odor gases by condensation prior to step a).

7. The method of claim 1 wherein step b) is performed at a temperature of form about 920° C. to about 950° C.

8. The method of claim 1 further comprising separation of methanol containing a portion of the existing ammonia from said odor gases after step a) and before step b); and subsequently separating the ammonia from the methanol.

9. The method of claim 1 further comprising separation of methanol that contains a portion of the existing ammonia from said odor gases by condensation prior to step a); and subsequently separating the ammonia from the methanol.

10. A method of reducing nitrogen oxide emissions at a pulp mill during combustion of odor gases which generates nitrogen oxide flue gases comprising the steps of:

a) passing at least a portion of odor gases generated during pulp production through a condenser to produce a methanol stream containing a first portion of ammonia from the odor gas and an odor gas stream containing a second portion of ammonia from the odor gas;

b) separating the first portion of ammonia from said methanol stream of step a), and recovering a purified methanol stream and ammonia;

c) separating the second portion of ammonia from said odor gas stream of step a), and recovering a purified odor gas stream and ammonia; and then d) introducing the first portion of ammonia separated in step b), the second portion of ammonia separated in step c), or both into a recovery boiler;

whereby nitrogen oxide emissions from boiler flue gases are reduced by reaction of ammonia introduced to said recovery boiler in step d) with nitrogen oxides in said boiler flue gases.

11. The method of claim 10 wherein said purified methanol stream of step b) is burned in a power boiler.

12. The method of claim 10 wherein said purified methanol stream of step b) is introduced into said recovery boiler, an odor gas burner or an odor gas boiler as fuel.

13. The method of claim 10 wherein a portion of odor gases which is not passed through said condenser of step a) is introduced directly into said recovery boiler.

14. The method of claim 10 wherein said purified odor gas stream of step c) is introduced into said recovery boiler.

15. The method of claim 10 wherein ammonia is separated in step b), step c) or step b) and step c) by a water scrubber.

16. The method of claim 10 wherein ammonia is separated in step b), step c) or step b) and step c) by a molecular sieve.

17. The method of claim 10 wherein step d) is performed at a temperature of from about 920° C. to about 950° C.

18. The method of claim 16 wherein said molecular sieve is a zeolite.

19. A method of reducing nitrogen oxide emissions at a pulp mill during combustion of odor gases which generates nitrogen oxide flue gases comprising the steps of:

a) passing at least a portion of odor gases generated during pulp production through an ammonia separator to produce a purified odor gas stream and ammonia; and then, b) introducing the ammonia separated in step a) into a recovery boiler;

whereby nitrogen oxide emissions from boiler flue gases are reduced by reaction of ammonia introduced to said recovery boiler in step b) with nitrogen oxides in said boiler flue gases.

20. The method of claim 19 wherein a portion of odor gases which is not passed through said condenser of step a) is introduced directly into said recovery boiler.

21. The method of claim 19 wherein said ammonia separator is a water scrubber.

22. The method of claim 19 wherein said ammonia separator is a molecular sieve.

23. The method of claim 22 wherein said molecular sieve is a zeolite.

24. The method of claim 19 wherein step b) is performed at a temperature of from about 920° C. to about 950° C.

* * * * *